US006382358B1

(12) United States Patent
Kritzer

(10) Patent No.: US 6,382,358 B1
(45) Date of Patent: May 7, 2002

(54) SAFETY LOCK DEVICE FOR AUTOMOBILE LIFTS

(76) Inventor: Jeffrey Scott Kritzer, 12419 Willow Grove Ct., Moorpark, CA (US) 93021

( * ) Notice: Subject to any disclaimer, the term of this patent is extended or adjusted under 35 U.S.C. 154(b) by 0 days.

(21) Appl. No.: 09/702,560

(22) Filed: Oct. 31, 2000

(51) Int. Cl.[7] ..... B66F 7/04; B66F 17/00
(52) U.S. Cl. ..... 187/208; 187/363
(58) Field of Search ..... 187/208, 363

(56) References Cited

U.S. PATENT DOCUMENTS

| | | | |
|---|---|---|---|
| 2,238,573 | A | 4/1941 | Steedman |
| 2,266,915 | A | 12/1941 | Steedman |
| 3,237,722 | A | 3/1966 | Citroën |
| 4,328,951 | A | 5/1982 | Laupper |
| 4,331,219 | A | 5/1982 | Suzuki |
| 4,457,401 | A | 7/1984 | Taylor et al. |
| 4,531,614 | A | 7/1985 | Naegeli |
| 4,674,938 | A | 6/1987 | Van Stokes et al. |
| 4,856,618 | A | 8/1989 | Isogai |
| 4,976,336 | A | 12/1990 | Curran |
| 5,207,296 | A | 5/1993 | Beattie et al. |
| 5,207,297 | A | 5/1993 | Beattie et al. |
| 5,211,264 | A | 5/1993 | Beattie et al. |
| 5,489,182 | A | 2/1996 | Habicht |
| 5,645,388 | A | 7/1997 | Lacasse |
| 5,803,206 | A | 9/1998 | Halstead et al. |

FOREIGN PATENT DOCUMENTS

| | | |
|---|---|---|
| FR | 2.108.882 | 5/1972 |
| SU | 1279-935 A | 12/1986 |

*Primary Examiner*—Steven A. Bratlie
(74) *Attorney, Agent, or Firm*—Shughart Thomson & Kilroy P.C.

(57) ABSTRACT

The present invention comprises a safety lock device for an automobile lift having a lifting carriage slidably connected to a post and supported by a flexible lifting member, such as a chain or cable. The safety lock device comprises a ratchet lock mechanism which prevents inadvertent lowering of the carriage and a fail-safe mechanism which automatically engages the ratchet lock in the event that the flexible lifting member should fail or otherwise become slack while the ratchet lock is disengaged. The ratchet lock mechanism includes a ratchet track connected to the post and a ratchet pawl connected to the lifting carriage. When the ratchet pawl is in the track engaging position, the pawl allows the lifting carriage to move upward but prevents it from moving downward. The pawl is moved into the release position by a release lever pivotally connected to the ratchet pawl. A first end of the release lever is located proximate the post, and selectively engages the post so as to push the pawl away from the post and pivot the pawl into the release position. The ratchet lock mechanism is automatically engaged upon upward movement of the lifting carriage. The fail-safe mechanism includes a flexible member connector slidably mounted to the lifting carriage and movable between an upper position and a lower position. The flexible lifting member is attached to an upper end of the flexible member connector. A spring acts in opposition to tension in the flexible lifting member and urges the flexible member connector into the lower position upon loss of tension in the flexible lifting member. The flexible member connector is connected to the pawl release lever in such a manner that downward movement of the flexible member connector moves the release lever to engage the pawl and prevent downward movement of the lifting carriage.

12 Claims, 5 Drawing Sheets

37
3.
3.
39
16
9
7
7
21
23
23
21
11
5
5
3
35

SAFETY LOCK DEVICE FOR AUTOMOBILE LIFTS

BACKGROUND OF THE INVENTION

1. Field of the Invention

The invention relates to the field of automobile service lifts, and in particular to a safety lock mechanism for a post-type lift having a lifting carriage slidably mounted to a vertical post or column and supported by a chain, cable, or other flexible lifting member.

2. Description of the Related Art

A wide variety of post-type automobile lifts have been previously known and used in the automobile repair business to provide access to the underside of a vehicle. Post lifts can be either of the in-ground or above-ground variety. In-ground post lifts usually have one or two vertically ascending columns mounted below the floor of a garage or service area which are raised hydraulically to lift the vehicle. Above-ground post lifts generally have two or four vertical columns or "posts," each of which includes a lifting carriage which rides up and down the post and has one or more arms for engaging and raising the vehicle. These lifting carriages are often raised and lowered by means of a chain, cable, or other flexible lifting member which is driven by a winch or hydraulic actuator.

It has long been known to provide automobile lifts with a ratchet lock mechanism to prevent unintentional lowering of the lifting carriages, which could result in injury to the lift operator or damage to the vehicle or other property. These devices generally include a ratchet track, with a plurality of vertically spaced teeth, which is connected to the post and a ratchet pawl which is pivotally connected to the lifting carriage and selectively engages the ratchet track. When engaged, the ratchet lock mechanism allows the lifting carriage to be raised, but prevents it from being lowered. In order to lower the lifting carriage, the ratchet pawl must be manually disengaged from the ratchet track. A problem with some of these ratchet lock mechanisms is that in order for the mechanism to work, the ratchet must be manually re-engaged before the lift is raised again after being lowered.

If properly engaged, the ratchet lock mechanism will operated to prevent the lifting carriage from falling while the lift is being raised, but it cannot by itself provide an adequate level of safety because it must be disengaged to lower the lift. If one of the flexible lifting members should break while the lift is being lowered or at anytime when the ratchet lock is inadvertently left in the disengaged position, there is nothing to keep the respective lifting carriage from falling all the way to the bottom of the post. In order to provide complete safety, a safety lock device for an automobile lift should include a fail-safe mechanism which automatically re-engages the ratchet lock mechanism in the event that one of the flexible lifting members should break or otherwise becomes slack.

Several safety lock devices incorporating fail-safe devices have been previously known. U.S. Pat. No. 2,238,573 to E. H. Steedman discloses a winch and cable operated automobile lift having a fail-safe device wherein each cable is connected to a crank member which is pivotally attached to the inside of the lifting carriage. A spring provides tension which acts in opposition to the cable tension. Should the cable break, the spring tension would cause the crank member to rotate about its mounting point, allowing a dog on the crank member to engage one of a series of holes cut into the back side of the post, stopping downward travel of the carriage. A second patent to Mr. Steedman, U.S. Pat. No. 2,266,915 discloses a fail-safe mechanism comprising an escapement-type ratchet mechanism which is locked by means of a counterweight if the carriage begins to descend too quickly. While the safety devices disclosed by the Steedman patents provide fail-safe mechanisms designed to prevent the lift from falling in the event of a broken cable, they contain no provisions for preventing accidental of unintended lowering of the lift in the absence of such a mechanical failure.

U.S. Pat. No. 4,331,219 to Yasunori Suzuki discloses a safety device for a chain operated lift which includes a ratchet track attached to the column and a pawl pivotally connected to the carriage by a pivot rod. When the lift is being raised, the pawl is biased into an engaging position with the slot plate by a torsional spring. During lowering of the lift, the pawl is held in a disengaged position by a latching plate which is pivotally connected to the carriage and engages the tang of an action plate connected to the pawl pivot rod. The lifting chains are connected to the carriage by a suspension rod, and a coil spring acts on the suspension rod in opposition to the chain tension. A push rod connected to the suspension rod has a distal end in contact with the pawl latching plate. If the chain were to break, the coil spring would push the suspension rod and push rod downward, thereby pivoting the latching plate and releasing the action plate. The torsion spring would then rotate the pawl pivot rod and the pawl into the engaging position and prevent downward movement of the carriage.

The ratchet lock of the Suzuki lift is also equipped with a push rod connected to the pawl latching plate which has a distal end which engages the floor when the lifting carriage is fully lowered and automatically resets the pawl to its engaging position. This feature partially solves the problem of a lift operator forgetting to engage the ratchet lock before raising the lift, but it is only operative if the lift is lowered completely to the floor. It would still be possible for the operator to disengage the lock, partially lower the lift (to access another portion of the vehicle, for instance) and then raise the lift again without re-engaging the ratchet lock.

U.S. Pat. No. 4,457,401 to James J. Taylor, et al. discloses a chain operated hydraulic lift having a ratchet lock mechanism which includes a ratchet track welded to the post and a pawl pivotally connected to the carriage. The pawl is biased into a position engaging the ratchet track by a spring. The pawl is released by a foot pedal which applies tension to a cable connected to the pawl. The safety lock device also includes fail-safe mechanism which includes a chain tension sensing mechanism mounted at the top of the post. The chain sensing mechanism includes a pulley which is connected to the pawl release cable. If the chain breaks and thereby loses tension, the chain tension sensing mechanism is triggered, pivoting the pulley downward and releasing the tension on the pawl release cable, thereby causing the pawl to pivot into the engaging position and preventing downward movement of the carriage.

While the Taylor lift does provide a fail-safe mechanism in combination with a ratchet lock which automatically resets (the ratchet pawl returns to the engaging position when the operator releases the foot pedal), it does so at the expense of making the operator stand in close proximity to the lift to keep the foot pedal depressed while the lift is descending, thereby increasing the likelihood of personal injury.

It is clear that there remains a need for a safety lock device which has both a ratchet lock device to prevent inadvertent lowering of the lift and a fail-safe device to engage the ratchet lock in the event of a flexible lifting member failure during lowering, the ratchet lock being designed so that it automatically re-engages itself anytime the lifting carriage begins to move upwardly.

SUMMARY OF THE INVENTION

The present invention comprises a safety lock device for an automobile lift having a lifting carriage slidably connected to a post and supported by a flexible lifting member, such as a chain or cable. The safety lock device comprises a ratchet lock mechanism which prevents inadvertent lowering of the carriage and a fail-safe mechanism which automatically engages the ratchet lock in the event that the flexible lifting member should fail or otherwise become slack while the ratchet lock is disengaged.

The ratchet lock mechanism includes a ratchet track which is connected to the post and a ratchet pawl which is connected to the lifting carriage and is pivotable between a track engaging position and a release position. The pawl is biased into the track engaging position by a spring. When the ratchet pawl is in the track engaging position, the pawl allows the lifting carriage to move upward but prevents it from moving downward.

The pawl is moved into the release position by a pawl release lever which is pivotally connected to the ratchet pawl. The release lever has first and second ends, the first end being located proximate the post, and is pivotable about a point intermediate the first and second ends between a first position and a second position. In the first position, the release lever first end is out of engagement with the post and the ratchet pawl is retained in the track engaging position by the spring, whereas in the second position the release lever first end engages the post so as to push the pawl away from the post and pivot the pawl into the release position.

The ratchet lock mechanism is automatically engaged upon upward movement of the lifting carriage, since such upward movement with the pawl release lever in the second position causes the pawl release lever first end to pivot downwardly, moving the pawl release lever into the first position and thereby allowing the pawl spring to urge the ratchet pawl into the track engaging position.

The fail-safe mechanism includes a flexible member connector which is mounted to the lifting carriage and is slidable between an upper position and a lower position. The flexible lifting member is attached to an upper end of the flexible member connector such that tension in the flexible lifting member holds the flexible member connector in the upper position. A spring connected to the flexible member connector acts in opposition to tension in the flexible lifting member and urges the flexible member connector into the lower position upon loss of tension in the flexible lifting member. A trip lever connected to the lifting carriage below the flexible member connector has a first end in contact with the flexible member connector and a second end connected to the pawl release lever. The trip lever is pivotable with respect to the lifting carriage about a point intermediate its first and second ends such that the first end moves downwardly and the second end moves upwardly as the flexible member connector moves from the upper position to said lower position. The upward movement of the trip lever second end pivots the pawl release lever into its first position, allowing the pawl to be pivoted into the track engaging position by its spring.

OBJECTS AND ADVANTAGES OF THE INVENTION

The principal objects and advantages of the present invention include: providing a safety lock device for an automobile lift which prevents inadvertent lowering of the lift; providing such a safety lock device which includes a fail-safe mechanism which automatically engages the safety lock upon failure of a flexible lifting member; providing such a safety lock device which automatically engages the safety lock upon upward movement of the lift; providing such a safety lock device which can be fully contained and protected within the structure of a lifting carriage of the lift; and providing such a safety lock device which is economical to manufacture, efficient in operation, capable of a long operating life and particularly well-adapted for the proposed usage thereof

DETAILED DESCRIPTION OF THE PREFERRED EMBODIMENT

Figure 1:
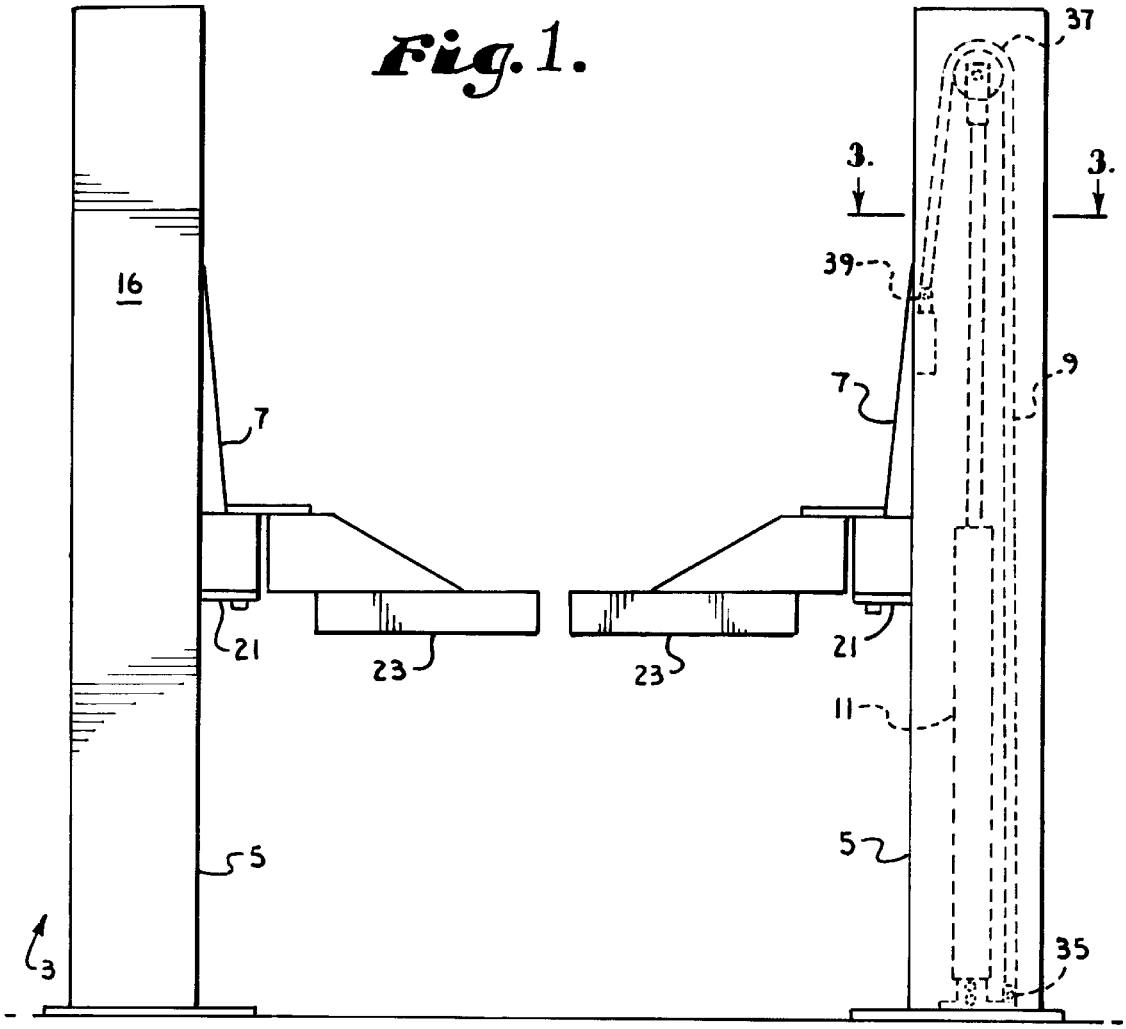
FIG. 1 is an end view of a post-type automobile lift.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 generally designates a safety lock device embodying the present invention. The safety lock device 1 is designed for use on a post-type automobile lift 3 having one or more (usually either two or four) upright columns or posts 5 which each support a respective, vertically moveable lifting carriage 7. The lifting carriages 7 are each raised and lowered by a cable, chain, or other flexible lifting member 9 which is fastened at one end to the respective lifting carriage 7.

The lift 3 will generally be described and depicted herein as one in which the flexible lifting members 9 are roller chains connected between a lifting carriage 7 and the bottom of the respective post 5 and driven by a hydraulic actuator 11, as shown in FIG. 1, however it is to be understood that the safety lock device 1 is equally applicable to lifts utilizing cables or other types of flexible lifting members 9 which may be driven by electric winches or by or other suitable means. Because the safety lock devices 1 associated with each of the posts 5 are basically identical to each other, only a single post 5 and its associated safety lock device 1 will be described in detail herein.

The post 5 has a generally square cross-section and includes a front wall 13 with a channel 15 which accepts the lifting carriage 7, opposing sidewalls 16, and a back wall 17 opposite the front wall 13. The lifting carriage 7 includes an upright frame member 19 which rides within the post 5 and a generally horizontal cross member 21 connected to the frame member 19 which rides outside of the post 5 and supports a pair of lifting arms 23 which engage the underside of a vehicle to be raised on the lift 3. The frame member 19 has a generally square cross-section which conforms to the interior of the post 5 and includes a front wall 25, a first sidewall 27 oriented perpendicular to the front wall 25 and a second sidewall 29 opposite the first sidewall 27. The back side of the frame member 19 is open so that the interior of the frame member 19 communicates with the back wall 17 of the post 5. The frame member 19 has an upper end 31 and a lower end (not shown), both of which are open to the interior of the post 5.

The flexible lifting member or lifting chain 9 is connected at a first end 35 to a point on the interior of the post 5 proximate its base and extends upwardly therefrom and loops over a roller or sprocket 37 connected to the ram end of the hydraulic actuator 11. From the sprocket 37 the lifting chain 9 extends downwardly through the upper end 31 of the lifting carriage frame member 19 and is attached at a second end 39 to the interior surface of the frame member front wall 25. As the hydraulic actuator 11 is extended, the second end 39 of the lifting chain 9 is pulled upward, raising the lifting carriage 7 and any vehicle positioned on the lifting arms 23. Retracting the actuator 11 results in the downward movement of the chain second end 39 and the lowering of the carriage 7.

Figure 2:
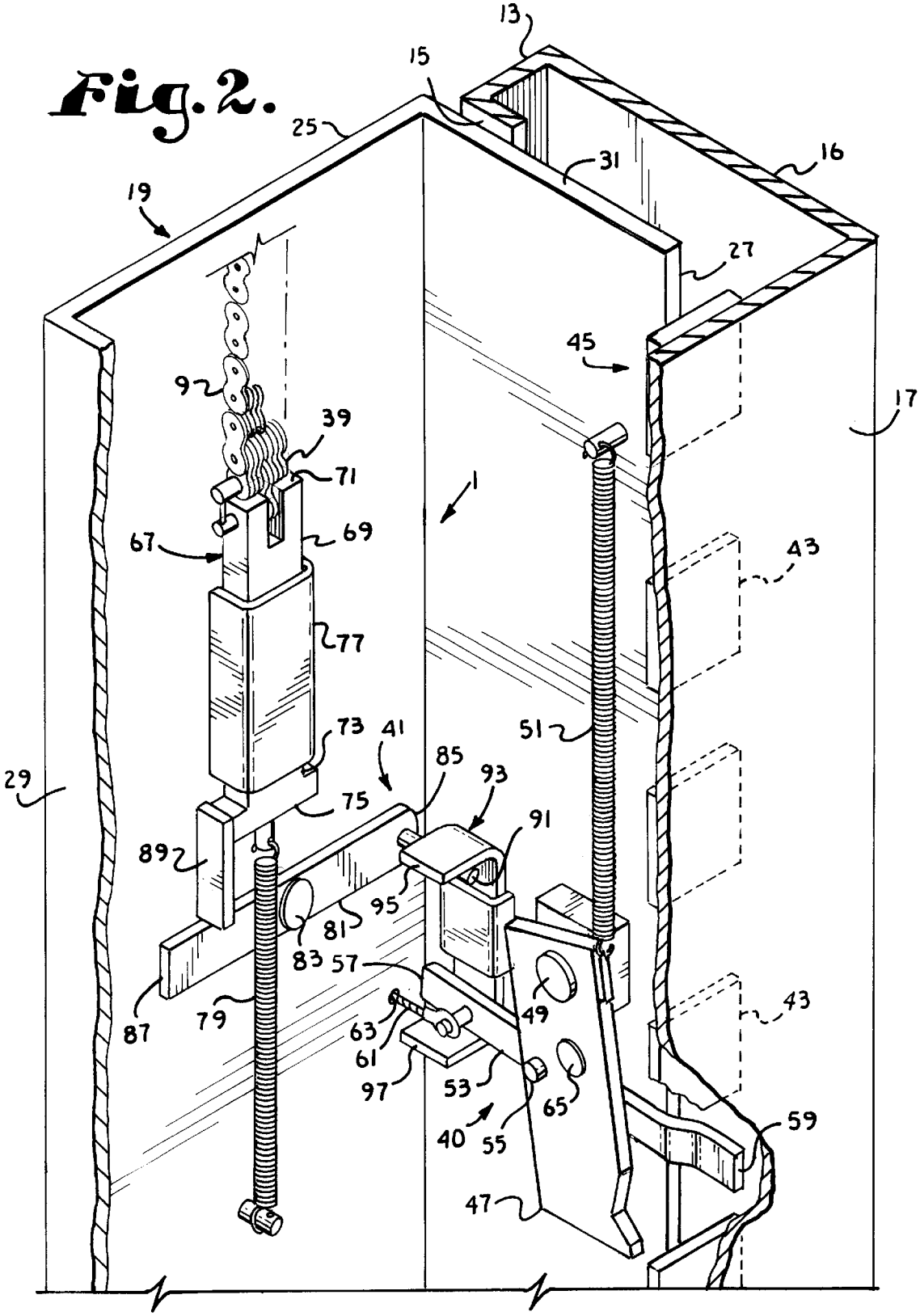
FIG. 2 is a cut-away perspective view of one of the posts of the automobile lift of FIG. 1 showing a safety lock mechanism embodying the present invention.
Figure 3:
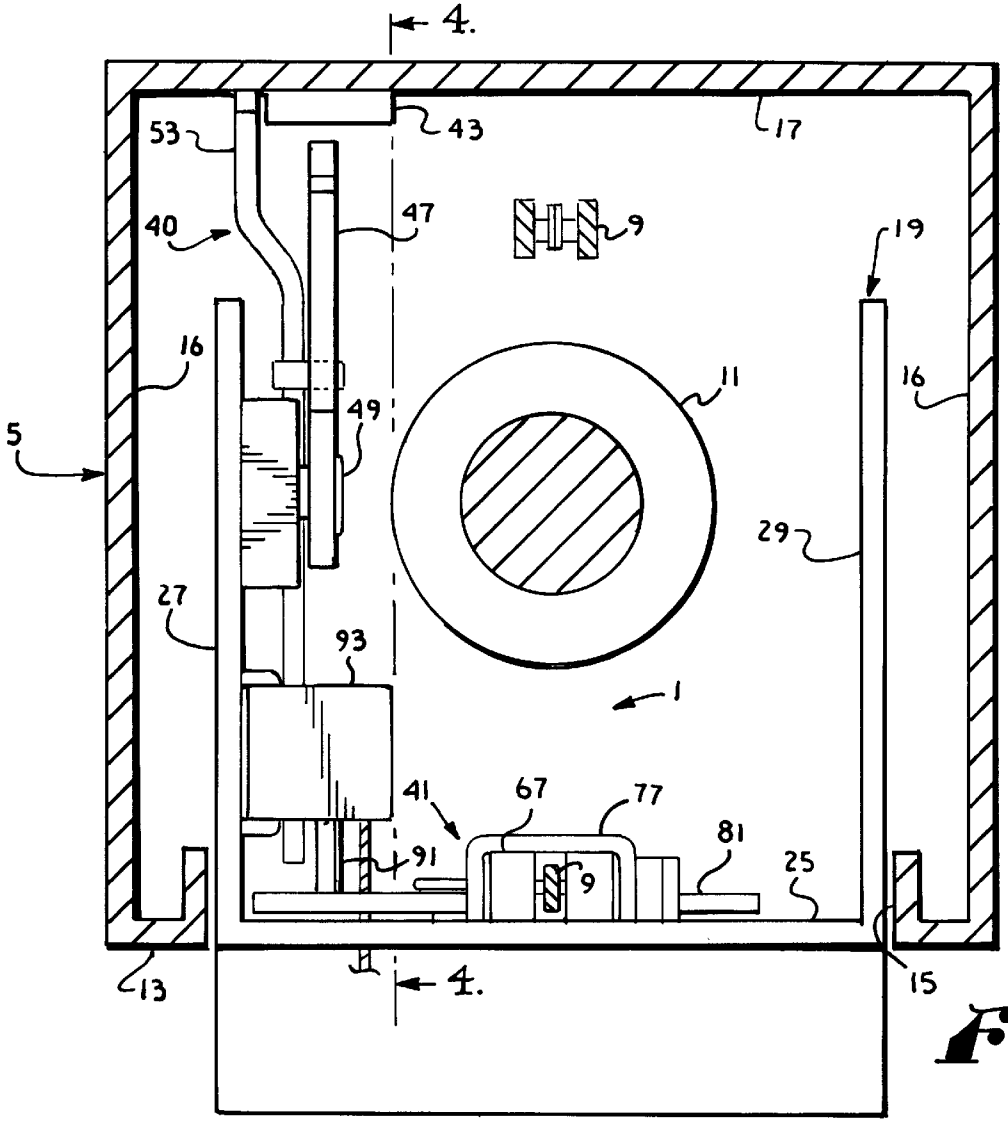
FIG. 3 is a cross-sectional view of one of the posts of the automobile lift taken generally along line 3—3 in FIG. 1 showing the safety lock mechanism of FIG. 2.
Figure 4:
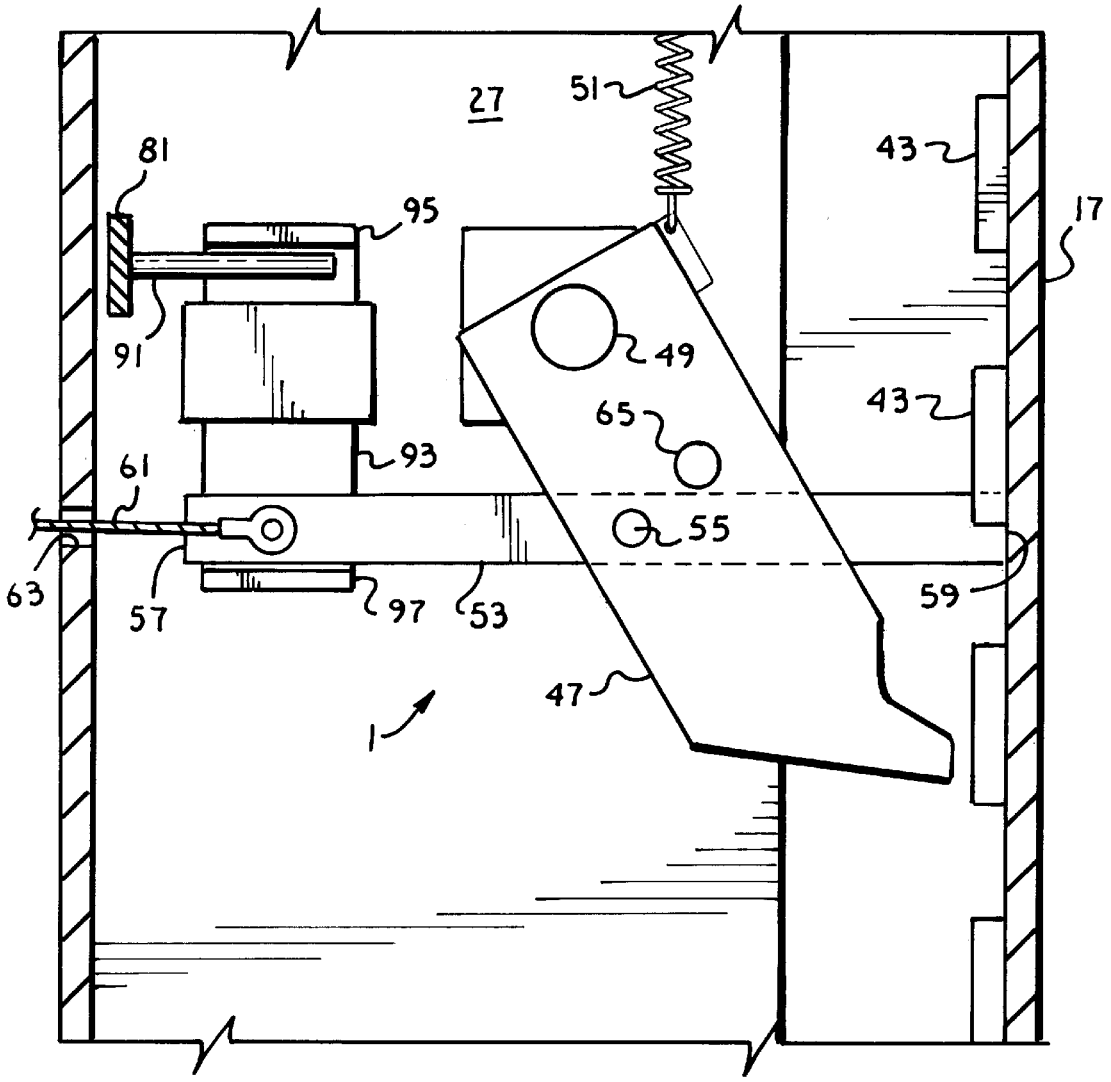
FIG. 4 is a cross-sectional view of the post taken generally along line 4—4 in FIG. 3 showing the safety lock mechanism of FIG. 2 in the released position.
Figure 5:
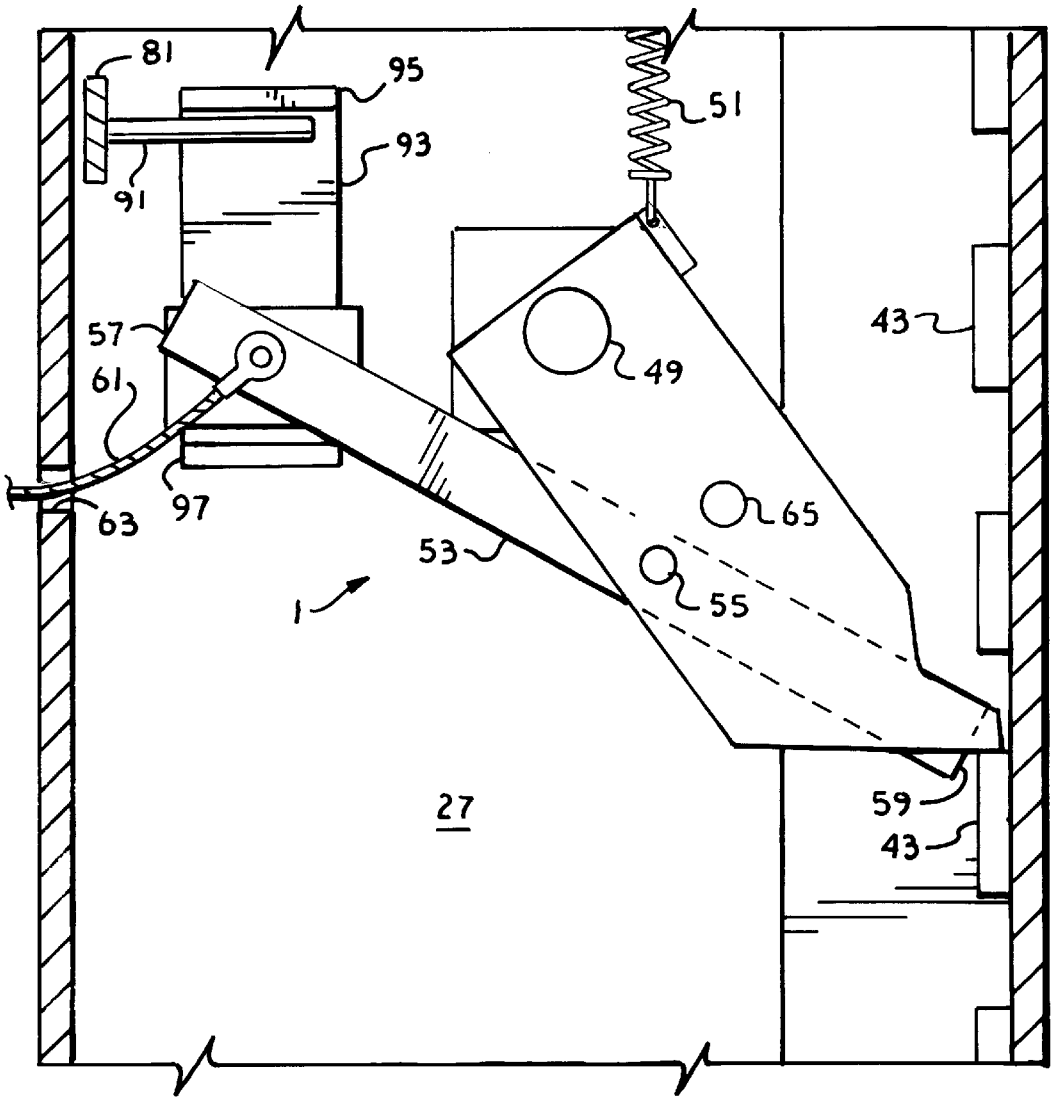
FIG. 5 is a cross-sectional view of the post taken from the same vantage point as FIG. 4 but with the safety lock mechanism in the locked position.

Referring to FIGS. 2 and 3, the safety lock device 1 includes both a ratchet lock mechanism 40 and a fail-safe mechanism 41. The ratchet lock mechanism 40 serves as a primary safety device to prevent the carriage 7 from lowering unexpectedly while the lift 3 is being raised. The ratchet lock mechanism 40 includes a plurality of safety lock blocks 43 welded to the back wall 17 of the post 5 in spaced vertical relation to one another so as to form a ratchet track 45, and a ratchet pawl 47 which is pivotally connected to the interior surface the first sidewall 27 of the carriage frame member 19 by a pivot pin 49. The ratchet pawl 47 pivots about the pin 49 between a track engaging position (as shown in FIG. 5) wherein the pawl 47 engages the ratchet track 45 of the post back wall 17 and a release position (as shown in FIG. 4) wherein the pawl 47 is free of the track 45. The pawl 47 is biased into the track engaging position by an extension spring 51 connected between the pawl 47 and the sidewall 27. The spring 51 is connected to the pawl 47 between the pivot pin 49 and the tip of the pawl 47 and is mounted at an opposite end above the pawl 47 to pull or pivot the pawl 47 upward into a track engaging position. The length of the pawl 47 between its pivot point 49 and the track 45 is such that the pawl 47 generally cannot rotate upward past a point of engagement with the track 45, thereby preventing the lifting carriage 7 from falling freely relative to the post 5. When the pawl 47 is in the track engaging position, the pawl 47 easily floats over the safety lock blocks 43 of the ratchet track 45 to allow the carriage 7 to rise relative to the post 5, but engages the blocks 43 to prevent the carriage 7 from moving downwardly.

In order to lower the carriage 7, the pawl 47 must be pivoted into the release position (FIG. 4) and held in the release position against the bias of the spring 51. This is accomplished by means of a release bar 53 which is pivotally connected to the ratchet pawl 47 by a pivot pin 55 so as to extend generally flush with the pawl 47. The release bar 53 pivots about the pivot pin 55 proximate its midpoint and has a front end 57 and a back end 59. A release cable 61 is connected to the release bar 53 proximate the front end 57 and extends downwardly therefrom to an opening 63 in the carriage frame member front wall 25. The cable 61 exits the interior of the frame member 19 through the opening 63 and extends outwardly so that it can be grasped by an operator of the lift 3. When the operator wishes to lower the lift 3, he or she pulls on the release cable 61 which causes the front end 57 of the release bar 53 to pivot downwardly about the pivot pin 55 and the back end 59 to pivot upwardly. As it moves upwardly, the back end 59 of the release bar 53 contacts the back wall 17 of the post 5, which pushes the pawl 47 away from the ratchet track 45 and into the release position and holds it there so that the carriage 7 may be lowered. A stop pin 65 connected to the pawl 47 engages the release bar 53 and prevents the back end 59 from pivoting so far upwardly that the pawl 47 can re-engage the ratchet track 45.

The back end 59 of the release bar 53 remains in contact with the back wall 17 of the post 5 until the lifting carriage 7 is moved upwardly again. Upward movement of the lifting carriage 7 causes the release bar back end 59 to pivot downwardly, thereby automatically returning the pawl 47 to its track engaging position (FIG. 5). This design feature provides an added safety measure by making it impossible to raise the lift 3 and inadvertently leave the ratchet lock mechanism 40 disengaged.

Referring again to FIGS. 2 and 3, the safety lock device 1 further includes the fail-safe mechanism 41 which functions to pivot the pawl 47 back into the track engaging position should the chain 9 break or become slack while the pawl 47 is disengaged, for instance during lowering of the carriage 7. The second end 39 of the chain 9 is attached to the interior surface of the frame member front wall 25 by means of a chain connector 67 which is shaped in the form of an inverted T, having a vertical body 69 with a top end 71 and a bottom end 73, and a horizontal head 75 connected to the bottom end 73 of the body 69. The second end 39 of the chain 9 is connected to the top end 71 of the body 69. The body 69 is slidably received by a collar 77 having a U-shaped cross-section which is welded to the front wall 25, capturing the chain connector 67 between the collar 77 and the wall 25. The chain connector 67 is biased downward by an extension spring 79 which is connected between the head 75 and the frame member front wall 25.

A trip lever 81 is pivotally mounted to the frame member front wall 25 below the chain connector 67 by a pivot pin 83. The trip lever 81 is pivoted proximate its midpoint and has a first end 85 proximate the frame member first sidewall 27 and a second end 87 proximate the frame member second sidewall 29. A chain connector extension bar 89 extends downward from the chain connector head 75 and contacts the trip lever 81 proximate the second end 87. A trip lever pin 91 extends outwardly from the trip lever 81 proximate the first end 85. A U-shaped pull-up bar 93 having an upper flange 95 and a lower flange 97 is slidably mounted to the frame member first sidewall 27 so that the upper flange 93 is located above and in contact with the trip lever pin 91, and the lower flange 95 is located just below the release bar 53 proximate the front end 57.

Under normal circumstances, the head 75 of the chain connector 67 is held against the collar 77 by the weight of the lifting carriage 7 and any vehicle supported on the lifting arms 23. Should the chain 9 break or otherwise become slack, however, the spring 79 will then pull the chain connector 67 downwardly. As the chain connector head 75 moves downwardly, the extension bar 89 pushes the trip lever second end 87 downwardly, forcing the trip lever first end 85 upwardly. As the trip lever first end 85 moves upwardly, the trip lever pin 83 urges the pull-up bar 93 upwardly as well. As the pull-up bar 93 moves upwardly, the lower flange 97 contacts the release bar front end 57 and pulls it upwardly as well, causing the release bar back end 59 to pivot downwardly and away from the post back wall 17, allowing the pawl 47 to be pulled back into the track engaging position by the spring 51. Once in the track engaging position, the pawl 47 engages the ratchet track 45 and prevents downward movement of the carriage 7.

It is to be understood that while certain forms of the present invention have been illustrated and described herein, it is not to be limited to the specific forms or arrangement of parts described and shown. The safety lock device 1 can be adapted for use with virtually any post type lift 3, and the configuration of the lift 3 described herein, including the generally square cross-sectional shape of the post 5 and lifting carriage frame member 19, is exemplary only. Furthermore, while the ratchet track 45 has been described herein as a series of vertically spaced blocks 43, it could be formed in a variety of other ways, including a series of spaced holes, pins, or teeth, and still be within the scope of the present invention.

What is claimed and desired to be secured by Letters Patent is as follows:

1. A safety lock device for an automobile lift having a lifting carriage slidably connected to a post and supported by a flexible lifting member, the safety lock device including a ratchet lock mechanism comprising:

a) a ratchet track connected to the post;

b) a ratchet pawl connected to the lifting carriage and pivotable between a track engaging position and a release position, in said track engaging position said pawl allowing upward movement of the lifting carriage and preventing downward movement of the lifting carriage;

c) a first spring urging said pawl into said track engaging position; and d) a pawl release lever pivotally connected to said ratchet pawl and having a first end which is selectively engageable with the post so as to pivot said ratchet pawl into said release position.

2. The safety lock device as in claim 1, and further including a fail-safe mechanism comprising:

a) a flexible member connector slidably mounted to the lifting carriage and movable between an upper position and a lower position, the flexible lifting member being attached to an upper end of said flexible member connector, tension in the flexible lifting member holding said flexible member connector in said upper position;

b) a second spring connected to said flexible member connector and acting in opposition to tension in the flexible lifting member, said second spring urging said flexible member connector into said lower position only upon loss of tension in the flexible lifting member; and wherein c) said flexible member connector is connected to said pawl release lever such that movement of said flexible member connector from said upper position to said lower position causes said pawl release lever first end to pivot out of engagement with the post and thereby allows said first spring to urge said ratchet pawl into said track engaging position.

3. The safety lock device as in claim 2, wherein initial upward movement of the lifting carriage with said pawl release lever first end in engagement with the post causes said pawl release lever first end to pivot downwardly and out of engagement with the post, thereby allowing said first spring to urge said ratchet pawl into said track engaging position.

4. The safety lock device as in claim 3, wherein said pawl release lever further includes a second end, said pawl release lever being pivotable with respect to said ratchet pawl about a point intermediate said first and second ends, and said flexible member connector is connected to said pawl release lever by a linkage including:

a) a trip lever pivotally connected to the lifting carriage below said flexible member connector and having first and second ends, said first end being in contact with said flexible member connector, said trip lever being pivotable with respect to said lifting carriage about a point intermediate said first and second ends, said trip lever first end moving downwardly and said trip lever second end moving upwardly as said flexible member connector moves from said upper position to said lower position, said trip lever including a trip lever pin proximate said trip lever second end; and b) a generally U-shaped pull-up bar slidably connected to the lifting carriage and having an upper flange and a lower flange, said upper flange being located above and in contact with said trip lever pin and said lower flange being located just below the release bar proximate the second end thereof.

5. The safety lock device as in claim 4, and further including a release cable connected to said release lever second end, said release cable being adapted for gripping and pulling by a lift operator to pivot said release lever into said second position and thereby move said ratchet pawl into said release position.

6. A safety lock device for an automobile lift having a lifting carriage slidably connected to a post and supported by a flexible lifting member, the safety lock device including a ratchet lock mechanism comprising:

a) a ratchet track connected to the post;

b) a ratchet pawl connected to the lifting carriage and pivotable between a track engaging position and a release position, in said track engaging position said pawl allowing upward movement of the lifting carriage and preventing downward movement of the lifting carriage;

c) a first spring urging said pawl into said track engaging position; and d) a pawl release lever pivotally connected to said ratchet pawl and having first and second ends, said first end extending proximate the post, said pawl release lever being pivotable with respect to said ratchet pawl about a point intermediate said first and second ends between a first position wherein said release lever first end is out of engagement with the post and said first spring retains said ratchet pawl in said track engaging position and a second position wherein said release lever first end engages the post so as to pivot said ratchet pawl into said release position, initial upward movement of the lifting carriage with said pawl release lever in said second position causing said pawl release lever first end to pivot downwardly, moving said pawl release lever into said first position and thereby allowing said first spring to urge said ratchet pawl into said track engaging position.

7. The safety lock device as in claim 6, and further including a fail-safe mechanism comprising:

a) a flexible member connector mounted to the lifting carriage and slidable between an upper position and a lower position, the flexible lifting member being attached to an upper end of said flexible member connector, tension in the flexible lifting member holding said flexible member connector in said upper position;

b) a second spring connected to said flexible member connector and acting in opposition to tension in the flexible lifting member, said second spring urging said flexible member connector into said lower position only upon loss of tension in the flexible lifting member; and wherein c) said flexible member connector is connected to said pawl release lever such that movement of said flexible member connector from said upper position to said lower position causes said pawl release lever to pivot into said first position and thereby allows said first spring to urge said ratchet pawl into said track engaging position.

8. The safety lock device as in claim 7, wherein said flexible member connector is connected to said pawl release lever by a linkage including:

a) a trip lever pivotally connected to the lifting carriage below said flexible member connector and having first and second ends, said first end being in contact with said flexible member connector, said trip lever being pivotable with respect to said lifting carriage about a point intermediate said first and second ends, said trip lever first end moving downwardly and said trip lever second end moving upwardly as said flexible member connector moves from said upper position to said lower position, said trip lever including a trip lever pin proximate said trip lever second end; and b) a pull-up bar having an upper flange and a lower flange, said upper flange being located above and in contact with said trip lever pin and said lower flange being located just below the release bar proximate the second end thereof.

9. A safety lock device for an automobile lift having a lifting carriage slidably connected to a post and supported by a flexible lifting member, the safety lock device comprising:

a) a ratchet lock mechanism including:

i) a ratchet track connected to the post;

ii) a ratchet pawl connected to the lifting carriage and pivotable between a track engaging position and a release position, in said track engaging position said pawl allowing upward movement of the lifting carriage and preventing downward movement of the lifting carriage;

iii) a first spring urging said pawl into said track engaging position; and iv) a pawl release lever connected to said ratchet pawl and having first and second ends, said first end extending proximate the post, said pawl release lever being pivotable with respect to said pawl about a point intermediate said first and second ends between a first position wherein said release lever first end is out of engagement with the post and said first spring retains said ratchet pawl in said track engaging position and a second position wherein said release lever first end engages the post so as to pivot said ratchet pawl into said release position; and b) a fail-safe mechanism including:

i) a flexible member connector mounted to the lifting carriage and slidable between an upper position and a lower position, the flexible lifting member being attached to an upper end of said flexible member connector, tension in the flexible lifting member holding said flexible member connector in said upper position;

ii) a second spring connected to said flexible member connector and acting in opposition to tension in the flexible lifting member, said second spring urging said flexible member connector into said lower position only upon loss of tension in the flexible lifting member; and iii) a trip lever connected to the lifting carriage below said flexible member connector and having a first end in contact with said flexible member connector and a second end connected to said pawl release lever second end, said trip lever being pivotable with respect to said lifting carriage about a point intermediate said first and second ends, said trip lever first end moving downwardly and said trip lever second end moving upwardly as said flexible member connector moves from said upper position to said lower position, said upward movement of said trip lever second end pivoting said pawl release lever into said first position and thereby allowing said first spring to urge said ratchet pawl into said track engaging position.

10. The safety lock device as in claim 9, and further including a release cable connected to said release lever second end, said release cable being adapted for gripping and pulling by a lift operator to pivot said release lever into said second position and thereby move said ratchet pawl into said release position.

11. The safety lock device as in claim 9, wherein initial upward movement of the lifting carriage with said pawl release lever in said second position causes said pawl release lever first end to pivot downwardly, automatically moving said pawl release lever into said first position and thereby allowing said first spring to urge said ratchet pawl into said track engaging position.

12. The safety lock device as in claim 9, wherein said trip lever includes a trip lever pin proximate said trip lever second end and said trip lever second end is connected to said pawl release lever second end by a pull-up bar which has an upper flange and a lower flange, the upper flange being located above and in contact with the trip lever pin and the lower flange being located just below the release bar proximate the second end thereof.

* * * * *